US009982500B2

(12) United States Patent
Wilie et al.

(10) Patent No.: US 9,982,500 B2
(45) Date of Patent: May 29, 2018

(54) WELL EMERGENCY SEPARATION TOOL FOR USE IN SEPARATING A TUBULAR ELEMENT

(75) Inventors: Curtis Len Wilie, Alvin, TX (US); Simon McKay, Aberdeen (GB)

(73) Assignee: SHELL OIL COMPANY, Houston, TX (US)

( * ) Notice: Subject to any disclaimer, the term of this patent is extended or adjusted under 35 U.S.C. 154(b) by 173 days.

(21) Appl. No.: 14/241,244

(22) PCT Filed: Aug. 30, 2012

(86) PCT No.: PCT/US2012/053001

§ 371 (c)(1),
(2), (4) Date: Feb. 26, 2014

(87) PCT Pub. No.: WO2013/033306

PCT Pub. Date: Mar. 7, 2013

(65) Prior Publication Data

US 2014/0224500 A1 Aug. 14, 2014

Related U.S. Application Data

(60) Provisional application No. 61/530,558, filed on Sep. 2, 2011.

(51) Int. Cl.
*E21B 29/08* (2006.01)
*E21B 33/06* (2006.01)
(Continued)

(52) U.S. Cl.
CPC ..... *E21B 29/12* (2013.01); *E21B 29/02* (2013.01); *E21B 29/08* (2013.01); *E21B 33/062* (2013.01); *E21B 33/063* (2013.01)

(58) Field of Classification Search
None
See application file for complete search history.

(56) References Cited

U.S. PATENT DOCUMENTS 3,336,759 A * 8/1967 Cooper ..... E02B 17/00 166/297
4,323,117 A * 4/1982 Pierce ..... E21B 29/02 102/307

(Continued)

OTHER PUBLICATIONS

PCT International Search Report, Application No. PCT/US2012/053001 dated Jan. 30, 2013.

(Continued)

*Primary Examiner* — Matthew R Buck
*Assistant Examiner* — Douglas S Wood

(57) ABSTRACT

A method of separating a tubular element, comprising providing a tubular element having an inner and an outer surface, a circumference of said outer surface, a longitudinal axis and a first end and a second end; radially surrounding said tubular element with an explosive shaped charge material, wherein said shaped charge explosive material is capable of generating a high-velocity plasma jet in response to an activation signal, and wherein said explosive material comprises an electrically conductive layer; transmitting said activation signal to said explosive material; generating said high-velocity plasma jet; and separating said tubular element into a first portion comprising said first end and a second portion comprising said second end when said high-velocity plasma jet penetrates said outer surface of said tubular element and exits said inner surface of said tubular element.

38 Claims, 8 Drawing Sheets

(51) Int. Cl.

| | |
|---|---|
| ***F42B 1/02*** | (2006.01) |
| ***E02B 17/00*** | (2006.01) |
| ***E21B 29/02*** | (2006.01) |
| ***E21B 29/12*** | (2006.01) |

(56) References Cited

U.S. PATENT DOCUMENTS

| | | | | |
|---|---|---|---|---|
| 4,602,794 | A | 7/1986 | Schaeper et al. | |
| 4,685,521 | A | 8/1987 | Raulins | |
| 5,046,563 | A | 9/1991 | Engel et al. | |
| 5,133,419 | A * | 7/1992 | Barrington | E21B 17/07 166/242.7 |
| 5,251,702 | A | 10/1993 | Vazquez | |
| 5,253,585 | A | 10/1993 | Hudak et al. | |
| 5,777,257 | A | 7/1998 | Kenny | |
| 6,016,753 | A | 1/2000 | Glenn et al. | |
| 6,089,526 | A * | 7/2000 | Olson | E21B 33/062 251/1.1 |
| 6,125,928 | A | 10/2000 | Ninivaara et al. | |
| 7,354,026 | B2 | 4/2008 | Urrutia | |
| 7,410,003 | B2 | 8/2008 | Ravensbergen et al. | |
| 7,779,760 | B2 | 8/2010 | Konig | |
| 7,789,153 | B2 * | 9/2010 | Prinz | E21B 43/1185 102/222 |
| 8,393,393 | B2 * | 3/2013 | Rodgers | E21B 43/1195 102/302 |
| 8,714,251 | B2 * | 5/2014 | Glenn | E21B 17/07 166/297 |
| 2002/0129940 | A1 * | 9/2002 | Yang | C06B 25/00 166/299 |
| 2005/0133419 | A1 | 6/2005 | Long et al. | |
| 2010/0147519 | A1 | 6/2010 | Goodman | |

OTHER PUBLICATIONS

International Search Report dated May 11, 2012 of PCT/US2011/058292.

* cited by examiner

WELL EMERGENCY SEPARATION TOOL FOR USE IN SEPARATING A TUBULAR ELEMENT

PRIORITY CLAIM

The present application which is a 371 application of PCT/US2012/053001, filed Aug. 30, 2012, claims priority from US Provisional Application 61/530,558, filed Sep. 2, 2011.

FIELD OF THE INVENTION

The invention is directed towards a method for separating a tubular element, particularly when the tubular element is suspended above a subsea well experiencing an undesired flow of produced fluids.

BACKGROUND

U.S. Pat. No. 5,253,585 discloses that a main charge of explosive is positioned symmetrically about a passageway-forming tubular member, such as a well pipe assembly. The charge is outwardly and radially spaced from the member and is coupled thereto by a dense medium, such as soil, which is adapted to transfer the produced explosive energy to the tubular member in the form of a pressure pulse applied by the medium. Initiation charges are supplied at the outer surface of the main charge, to initiate a detonation wave directed at the tubular member. A layer of dense medium is provided to confine the non-coupled surface of the charge and retard venting of explosive gases away from the tubular member. In the end result, concentrated, converging pressure pulses are applied to the tubular member on detonation, to cause it to be symmetrically crimped to restrict the passageway. U.S. Pat. No. 5,253,585 is herein incorporated by reference in its entirety.

U.S. Pat. No. 7,779,760 discloses a shaped charge assembly that comprises a housing, first shaped charge, a wave shaping relay charge and a second shaped charge located in the housing. The assembly is configured such that a first active element formed by initiation of the first shaped charge causes detonation of the wave shaping relay charge, which in turn causes initiation of the second shaped charge to form a second active element. The first active element moves beyond a second end of the housing to cause damage of a first kind to an external target and the second active element also moves beyond the second end to cause damage of a second kind to the target. Shaped charges are known in the art, and U.S. Pat. No. 7,779,760 is one example. U.S. Pat. No. 7,779,760 is herein incorporated by reference in its entirety.

U.S. Pat. No. 4,602,794 discloses an annular blowout preventer for use on an oil or gas well rig having a lower housing, an upper housing, a resilient sealing means, a vertical bore coaxially positioned through the housing and a vertically acting piston for actuating the sealing means in which the inner surface of the upper housing and the inner surface of the lower housing are concentric spherical surfaces extending to the bore. The resilient sealing means includes steel segments extending between the top and bottom of the sealing means and the top and bottom of the sealing means and the steel segments have spherical surfaces coacting with the spherical surfaces on the upper and lower housings. The upper and lower housings each include a vertical wall extending downwardly from the spherical surfaces on the upper and lower housing and the vertical moving piston sealingly engages the vertical walls. U.S. Pat. No. 4,602,794 is herein incorporated by reference in its entirety.

U.S. Pat. No. 7,354,026 discloses a unitary blade seal for a shearing blind ram of a ram-type blowout preventer and includes an elongate member having a generally semi-circular cross section with a curved upper surface and a lower surface. The lower surface has a pair of laterally extending sides that taper outwardly and have a metal outer cap bonded thereto. The metal outer caps form an acute angle that engages a complementary groove formed in the upper ram of the shearing blind ram assembly. U.S. Pat. No. 7,354,026 is herein incorporated by reference in its entirety.

U.S. Pat. No. 5,251,702 discloses a surface controlled, subsurface safety valve in which a force due to control pressure fluid from a first source at the surface for opening the valve is opposed in part by a force due to reference pressure fluid from a second source at the surface, whereby the valve closes in response to a fail condition. U.S. Pat. No. 5,251,702 is herein incorporated by reference in its entirety.

U.S. Pat. No. 6,089,526 discloses a ram type blowout preventor whose rams have variable ram packers for sealing about pipes of different sizes in the bore of the preventor housing. Each ram packer includes a body of elastomeric material installed with a slot across the face of a metal ram body slidable with a guideway intersecting the bore of the preventor body. First and second sets of metal segments embedded in the body of elastomeric material beneath a top plate embedded in the packer body are so constructed and arranged as to prevent extrusion of the elastomeric material as the packers seal about the different sizes of pipe. U.S. Pat. No. 6,089,526 is herein incorporated by reference in its entirety.

There is a need in the art for one or more of the following:

Improved systems and methods for severing tubular elements;

Improved systems and methods for remotely severing tubular elements;

Improved systems and methods for remotely severing tubular elements when the tubular elements are in a subsea well; and/or Improved systems and methods for remotely severing tubular elements when the tubular elements are suspended above a subsea well that is flowing oil and gas at an undesirable rate.

SUMMARY OF THE INVENTION

One aspect of the invention provides a method of separating a tubular element, comprising providing a tubular element having an inner and an outer surface, a circumference of said outer surface, and a first end and a second end; radially surrounding said tubular element with an explosive shaped charge material, wherein said explosive shaped charge material is capable of generating a high-velocity plasma jet in response to an activation signal, and wherein said explosive material comprises an electrically conductive layer; transmitting said activation signal to said explosive material; generating said high-velocity plasma jet; and separating said tubular element into a first portion comprising said first end and a second portion comprising said second end when said high-velocity plasma jet penetrates said outer surface of said tubular element and exits said inner surface of said tubular element.

Another aspect of the invention provides a well emergency separation tool for separating a tubular element, comprising a tubular element having an inner and outer surface, a circumference of said outer surface, a longitudinal axis, and a first and second end; an explosive material, said explosive material radially surrounding said tubular element; a self-contained charge carrier, wherein at least a portion of said explosive material is contained with said charge carrier; and a trigger adapted to send an activation signal to said explosive material.

Another aspect of the invention provides a well emergency separation tool for separating a tubular element, comprising a tubular element having an inner and an outer surface, a circumference of said outer surface, and a first end and a second end; an explosive material, said explosive material radially surrounding said tubular element; a ram body, said ram body comprising an outer surface and an inner surface, said outer surface and said inner surface connected by a substantially flat face, wherein said flat face comprises an arcuate recess designed to engage a portion of said circumference of said tubular element, wherein at least a portion of said explosive material is contained with said ram body; and a trigger adapted to send an activation signal to said explosive material.

BRIEF DESCRIPTION OF THE DRAWINGS

So that the features and advantages of the present invention can be understood in detail, a more particular description of the invention may be had by reference to the embodiments thereof that are illustrated in the appended drawings. These drawings are used to illustrate only typical embodiments of this invention, and are not to be considered limiting of its scope, for the invention may admit to other equally effective embodiments. The figures are not necessarily to scale and certain features and certain views of the figures may be shown exaggerated in scale or in schematic in the interest of clarity and conciseness.

DETAILED DESCRIPTION

Presently preferred embodiments of the invention are shown in the above-identified figures and described in detail below. Embodiments may be described with reference to certain features and techniques for use on wells in a subsea environment.

Figure 1:
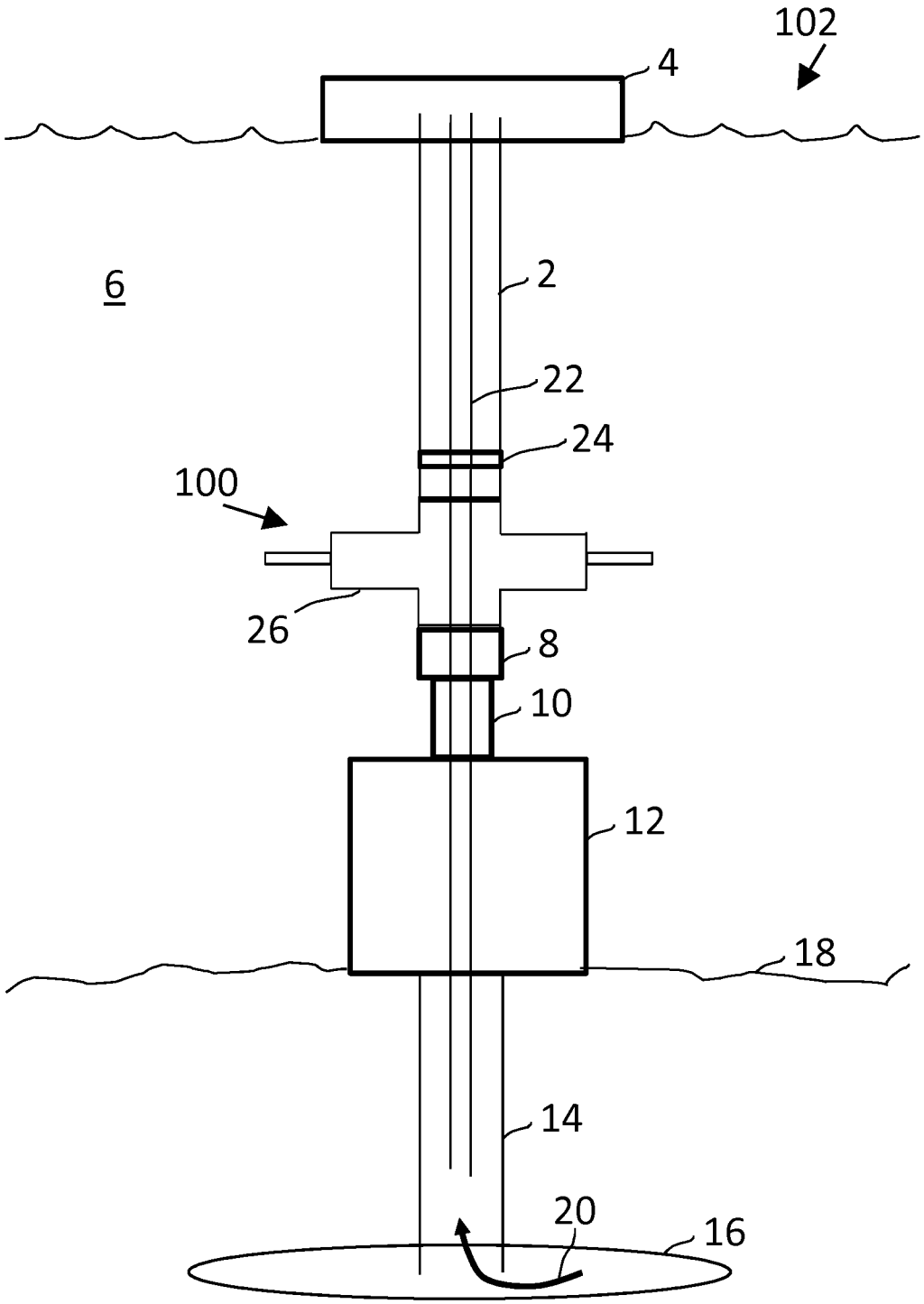
FIG. 1 is a schematic diagram depicting one embodiment of the well emergency separation tool positioned above a subsea reservoir.

FIG. 1:

FIG. 1 is a schematic diagram of well emergency separation tool 100 positioned about wellsite 102. Riser 2 is fluidly connected to surface structure 4. Suitable risers 2 are disclosed in co-pending U.S. Provisional Application 61/376,595, filed Aug. 24, 2010. U.S. Provisional Application 61/376,595 is herein incorporated by reference in its entirety.

Surface structure 4 floats on sea 6. Surface structure 4 may be, for example, a spar, a semisub, a TLP, an FPSO, a temporary or permanent storage system, a vessel, another containment apparatus, or a separator that separates components of fluid, such as gas and liquid, etc. Suitable surface structures 4 are disclosed in co-pending U.S. Provisional Application 61/376,542, filed Aug. 24, 2010, co-pending U.S. Provisional Application 61/376,534, filed Aug. 24, 2010 ; and co-pending U.S. Provisional Application 61/376,581, filed Aug. 24, 2010, U.S. Provisional Applications 61/376,542; 61/376,534; and 61/376,581 are herein incorporated by reference in their entirety.

Opposite surface structure 4, riser 2 is fluidly connected to well emergency separation tool 100. Well emergency separation tool 100 comprises ram housing 26. Ram housing 26 may be a metallic body as are known in the art, such as a standard forged body, provided by Cameron, Vetco-Gray, Patterson, Hydril, etc. Ram housing 26 contains a substantially vertical bore extending from riser 2 to flex joint 10. The outer surface of ram housing 26 may be fluidly isolated from sea 6. Opposite riser 2, well emergency separation tool 100 is fluidly connected to flex joint 10 by connector element 8. Flex joint 10 extends from connector element 8 to blowout preventer (BOP) stack 12. Casing 14 is a tubular element fluidly connected to BOP stack 12. BOP stack 12 may be located at or above mudline 18. BOP stack 12 may be any BOP stack as are known in the art and commercially available, such as those provided by Cameron, Vetco-Gray, Patterson, Hydril, etc. and disclosed, for example, in U.S. Pat. No. 7,410,003, herein incorporated by reference in its entirety. Fluid may flow from reservoir 16 through casing 14 towards surface in the direction marked by arrow 20.

During drilling or workover operations, workstring 22 may extend from surface structure 4 to casing 14. Workstring 22 is contained within riser 2 and passes through well emergency separation tool 100, connector element 8, flex joint 10, or BOP stack 12.

It may be desired to have multiple well emergency separation tools 100 installed between riser 2 and BOP stack 12. A second well emergency separation tool 100 may be included for redundancy. Alternatively, additional well emergency separation tools 100 may be included if various sizes or types of workstring 22 will be utilized. It may be desirable to install several sets of well emergency separation tools 100 to increase flexibility of design. Well emergency separation tool 100 may be installed when drilling operations commence and left on the BOP stack until all completion and workover activities are finished. Alternatively, well emergency separation tool 100 may be left on the well indefinitely and may be removed only when the well is decommissioned or when certain portions of well emergency separation tool 100 need to be repaired or replaced. Well emergency separation tool 100 is independent of traditional BOP stacks 12.

Figure 2:
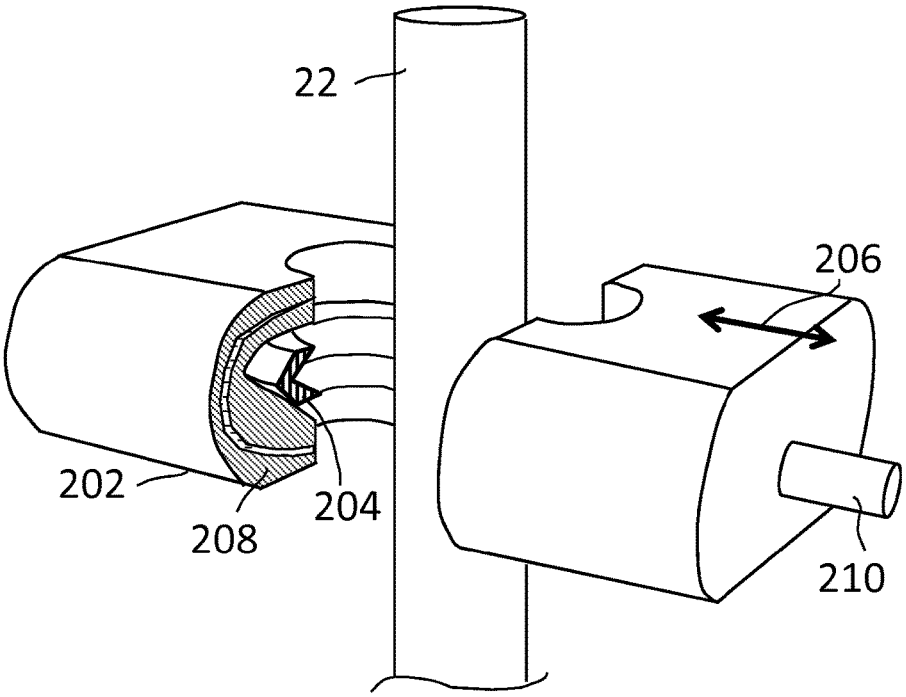
FIG. 2 is a schematic diagram of an embodiment of the internal structure of the well emergency separation tool.

FIG. 2:

FIG. 2 is a schematic diagram of the internal structure of ram housing 26. Workstring 22 may be a cylindrical element separated into approximately thirty to forty foot long sections called 'joints'. Workstring 22 may be a metallic element designed for oilfield use as is known in the art and commercially available from Patterson, Superior, Tuboscope, etc. Workstring 22 may be a small diameter workstring for use in well workovers, or workstring 22 may be a large diameter or heavy wall pipe used for drilling operations. Workstring 22 may range from about 1" (inch) up to 20" diameters. As seen in FIG. 1, workstring 22 passes through ram housing 26 in a substantially vertical manner.

Two opposing ram bodies 202 are contained within ram housing 26. Ram housing 26, as more fully discussed with reference to FIG. 1, is a standard ram housing 26 as is known in the art. Ram body 202 comprises an outer surface surrounded by ram housing 26 and an inner surface surrounding explosive material 204. Ram body 202 may be any standard ram body as is known in the art and available through commercial suppliers such as Cameron, Vetco-Gray, Patterson, Hydril, etc. The outer surface and the inner surface may be connected by a substantially flat face 208. Flat face 208 contains an arcuate recess designed to engage about one half the circumference of workstring 22. Opposing ram bodies 202 have complementary arcuate recesses designed to engage complimentary sections of the circumference of workstring 22 while also ensuring that opposing flat faces 208 properly abut. Ram body 202 may laterally translate towards or away from workstring 22 within ram housing 26, as shown by arrow 206. Lateral translation of ram body 202 is controlled by movable element 210. Movable element 210 may be a hydraulically activated piston, or may operate through alternative mechanical, hydraulic, etc. methods as are known in the art. The gap between workstring 22 and explosive element 204 may be controlled by the design of the arcuate recesses, flat faces 208, or movable element 210.

Ram housing and ram body design are known in the art and FIG. 2 merely provides a simplified diagram of one such design. FIG. 2 should not be taken to limit the present invention, the choice of the ram body design is not critical. Variable bore ram designs are also known in the art and may be used in the present invention, as disclosed in U.S. Pat. No. 6,089,526, herein incorporated by reference in its entirety.

Figure 3:
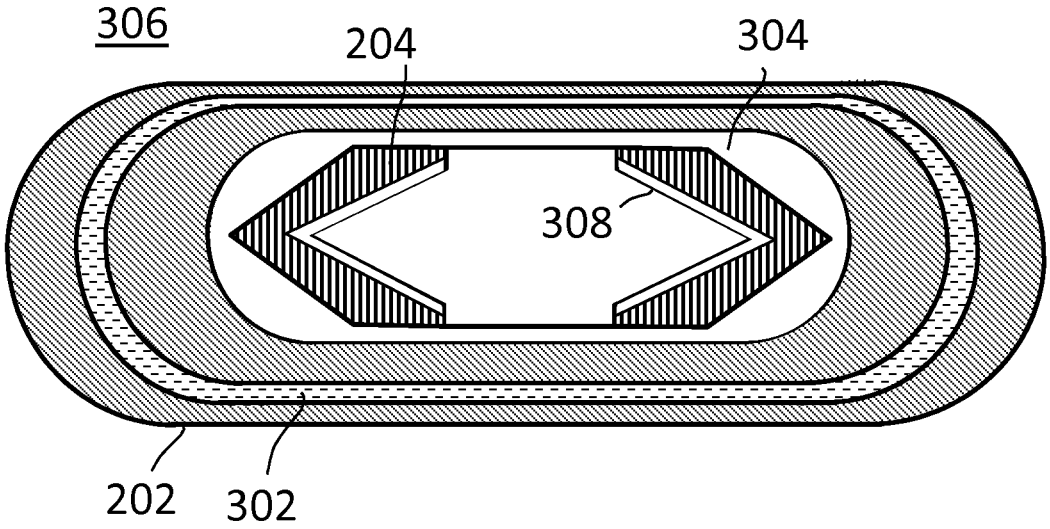
FIG. 3 is a cross-sectional view along the flat face of the ram body of the internal structure of an embodiment of the well emergency separation tool.

FIG. 3:

FIG. 3 contains a cross-sectional view along flat face 208 of FIG. 2. Sealing element 302 is fixedly connected to ram body 202 along flat face 208. Sealing element 302 may be an elastomeric sealing element, such as rubber, nitrile rubber, hydrogenated nitrile rubber, etc. as is known in the art. The inner surface of ram body 202 contains void 304. Void 304 surrounds explosive material 204.

Flat face 208 contains an arcuate recess designed to engage about one half the circumference of workstring 22. When the two ram bodies 202 abut along flat face 208, movable element 210 is designed such that opposing sealing elements 302 contact and begin to compress. As sealing elements 302 compress and extrude along flat face 208, sealing elements 302 sealingly isolate explosive material 204 from external environment 306, and any forces in external environment 306 from explosive material 204.

Explosive material 204 may contain an electrically conductive metallic liner 308, such as copper. When the two ram bodies 202 are abutted, sealing elements 302 compress and the opposing edges of metallic liner 308 contact and form a complete electrical circuit, allowing for a detonation signal to be conducted radially along explosive material 204.

Figure 4:
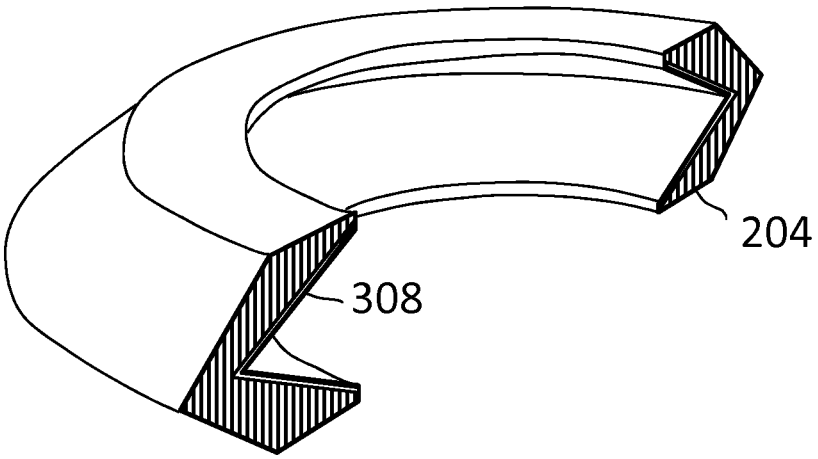
FIG. 4 is another view of one possible design of the explosive element contained within one embodiment of the well emergency separation tool.

FIG. 4:

FIG. 4 is another view of explosive material 204 as may be contained within ram body 202. The composition of explosive material 204 may be based on High Melting Explosive (HMX), Cyclotrimethylenetrinitramine (RDX), Hexanitrostilbene (HNS), Pentaerythritol tetranitrate (PETN), or any other explosive material known in the art. The composition, amount, or subsequent shape or design of explosive material 204 may be determined for a given application based on pressure, temperature, wall thickness, workstring 22 thickness, etc. The shape of explosive material 204 shown in FIG. 4 is purely illustrational and should not indicate a required shape.

Explosive material 204 may be designed such that when two ram bodies 202 are abutted, explosive material 204 radially encompasses a substantial portion of workstring 22 circumference to improve jet cutting characteristics. Shaped charges are known in the art, for example as disclosed in U.S. Pat. No. 7,779,760, which is herein incorporated by reference in its entirety. Explosive material 204 may be designed such that the high velocity jet of plasma is directed away from the inner surface of explosive material 204 and towards the outer surface of workstring 22.

Figure 5:
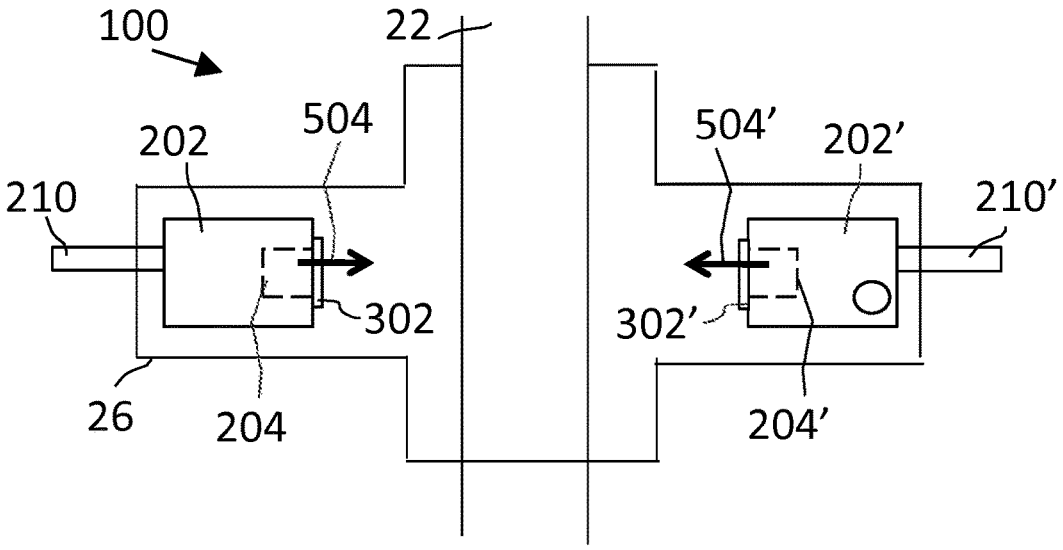
FIGS. 5-7 are schematic diagrams depicting a method of using one embodiment of the well emergency separation tool.
Figure 6:
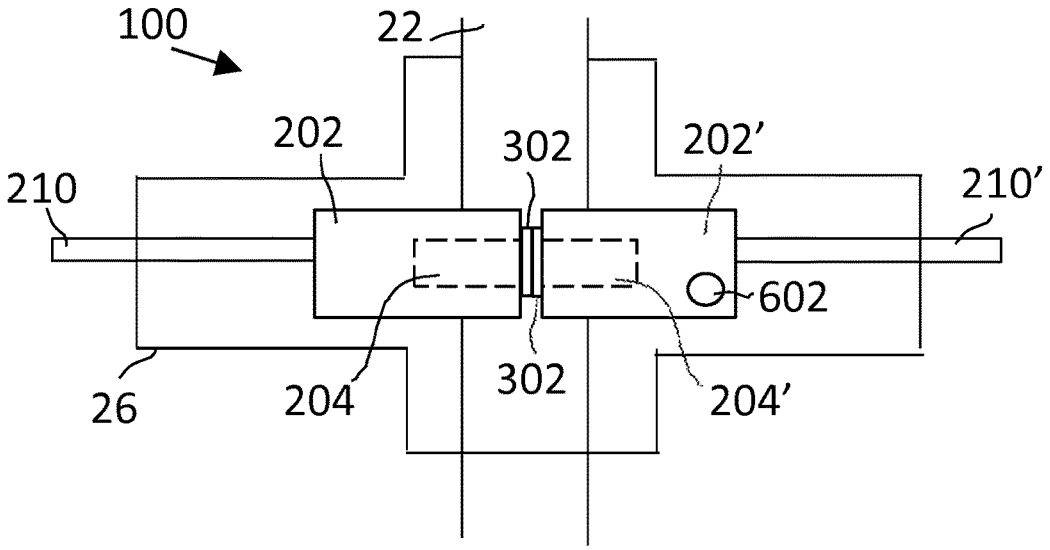
Figure 7:
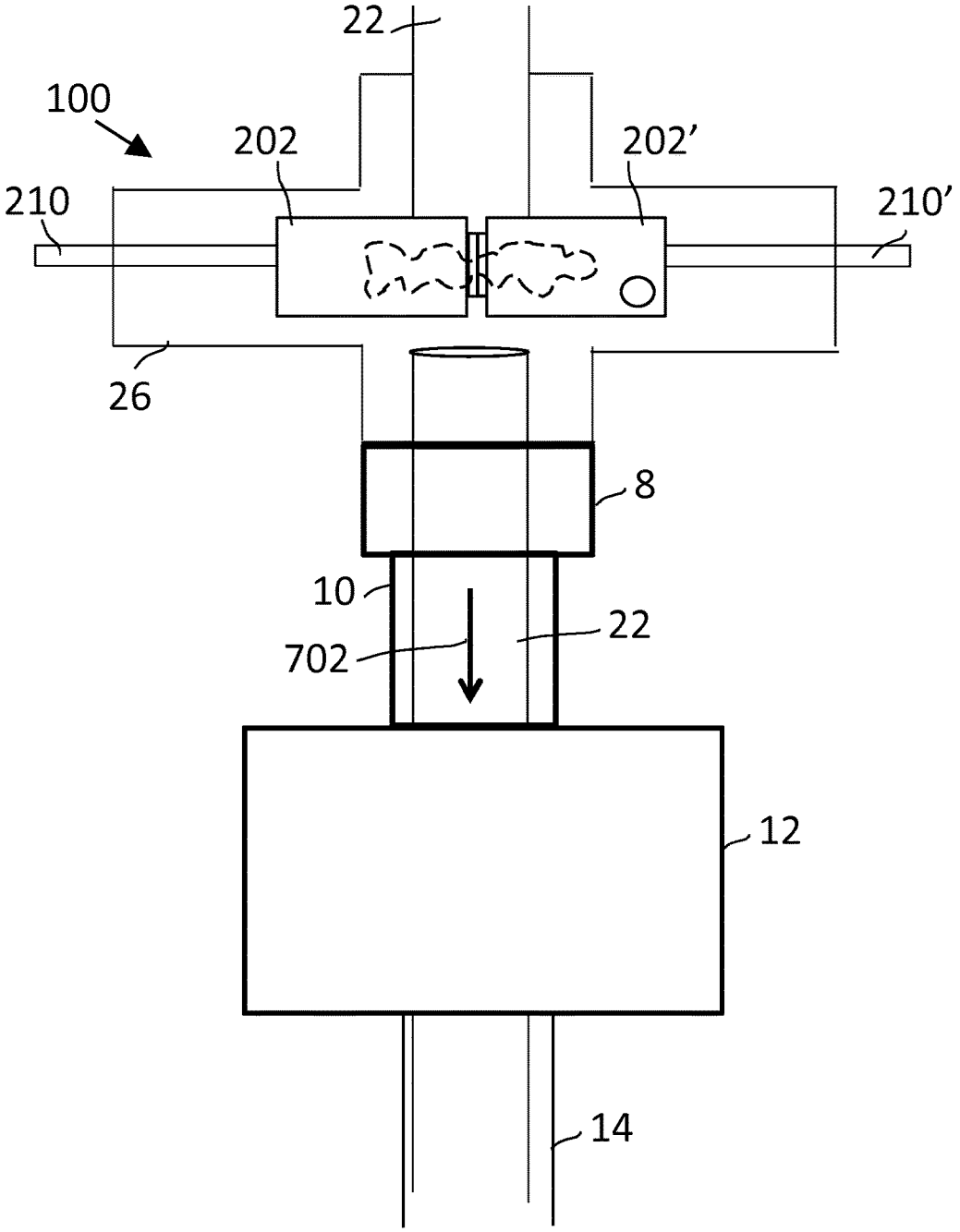

FIGS. 5-7:

FIGS. 5-7 contain a schematic diagram of how well emergency separation tool 100 may be used. All figures contain a close-up view of ram housing 26 as shown in FIG. 1. Only those items which differ from FIGS. 1-4 will be discussed herein, remaining features are more fully explained with respect to FIGS. 1-4.

In regular operating mode, FIG. 5, ram bodies 202, 202' are retracted away from workstring 22 in ram housing 26. Sealing elements 302, 302' are fixedly connected to ram bodies 202, 202' along flat faces 208. Workstring 22 passes through the bore of ram housing 26 in a substantially vertical manner. Workstring 22 is in line with the arcuate recesses of ram bodies 202, 202'.

When so desired, workstring 22 is secured at surface and movable elements 210, 210' are activated. Movable elements 210, 210' cause opposing ram bodies 202, 202' to translate laterally inward towards workstring 22, in the direction of arrows 504, 504'. Opposing ram bodies 202, 202' may translate laterally inwards at approximately the same speed.

As shown in FIG. 6, ram bodies 202, 202' translate toward each other and enclose workstring 22. The two sealing elements 302, 302' initially contact. When ram bodies 202, 202' are in the final position, sealing elements 302, 302' are compressed and sealingly isolate explosive material 204, 204'. Sealing elements 302, 302' may be designed so that proper stand-off between explosive material 204, 204' and workstring 22 is acquired. Ram bodies 202, 202' are abutted until the opposing edges of metallic liner 308 on explosive material 204 (shown in FIG. 3) contact and form a complete electrical circuit.

At this point, initiator 602 is electrically connected to explosive material 204, 204'. The location of initiator 602 in reference to FIG. 6 is merely one illustration and should not be taken as limiting. Initiator 602 may receive a detonation signal from a remote location and transmit that signal to activate explosive material 204, 204'. Initiator 602 may be any device capable of being integrated into well emergency separation tool 100 as is known in the art. A plurality of initiators 602 may be included for redundancy, such as 1-5 initiators, for example 2 initiators 602. Explosive material 204 may be designed such that a large pressure surge is created. A high-velocity jet of plasma will form, penetrate the outer surface of workstring 22, continue penetrating the entire thickness of workstring 22, and exit the inner surface of workstring 22, thereby cutting workstring 22. As explosive material 204, 204' may radially encompass workstring 22, the full circumference of workstring 22 will be cut, effectively severing workstring 22 into two distinct portions.

FIG. 7 is a schematic diagram of the system after workstring 22 is fully cut. According to FIG. 1, well emergency separation tool 100 is fluidly connected to flex joint 10 by connector element 8. Flex joint 10 extends from connector element 8 to BOP stack 12. Casing 14 is a tubular element fluidly connected to BOP stack 12. Once workstring 22 is fully cut, a portion of workstring 22 located below ram bodies 202, 202' falls in the direction of arrow 702 into the well. The newly cut end of workstring 22 passes through connector element 8, flex joint 10, and passes through BOP stack 12.

Attempting to close blind rams or blind-shear rams with workstring 22 across BOP stack 12 may be difficult or impossible depending on the size of workstring 22. Using the above method, workstring 22 is no longer located across BOP stack 12 and the blind rams or blind-shear rams may be effectively closed in order to effectively operate the BOP.

Once the newly cut end of workstring 22 has travelled through BOP stack 12, standard BOP rams may be shut to control the well. This method may be used in the case of uncontrolled flow from reservoir 16 through casing 14. This may include closing the blind rams and/or the blind-shear rams. Once the blind or blind-shear rams have been closed and the flowing fluids have temporarily halted, well emergency separation tool 100, riser 2, and surface structure 4 can be disconnected from BOP stack via connection element 8. Alternatively, movable elements 210, 210' may be retracted into ram housing 26 to allow tools to pass through the bore of ram housing 26. Appropriate remedial measures can then begin.

When explosive material 204 releases explosive energy, a high-velocity jet of plasma forms. In many cases a shock wave is also formed. It may be desired to incorporate a shock mitigator 24 (see FIG. 1) into riser 2. Shock mitigator 24 may be a solid barrier, such as a housing, or an energy absorbing material. Introduction of gas into a fluid may have a significant effect in reducing shock loading. Shock mitigator 24 may be a bubble curtain formed when pressurized gas is injected into the fluid contained within riser 2. One such desirable gas may be nitrogen for its inert properties. Introduction of pressurized gas into a fluid has been shown to reduce the effects of fluid shock up to a factor of ten. In the above sequence, shock mitigator 24 may be activated before explosive material 204 is activated to cut workstring 22. Although in FIG. 1, shock mitigator 24 is shown above well emergency separation tool 100, shock mitigator 24 may be integrated into well emergency separation tool 100 or located elsewhere in the system as is required for the given well and materials.

Figure 8:
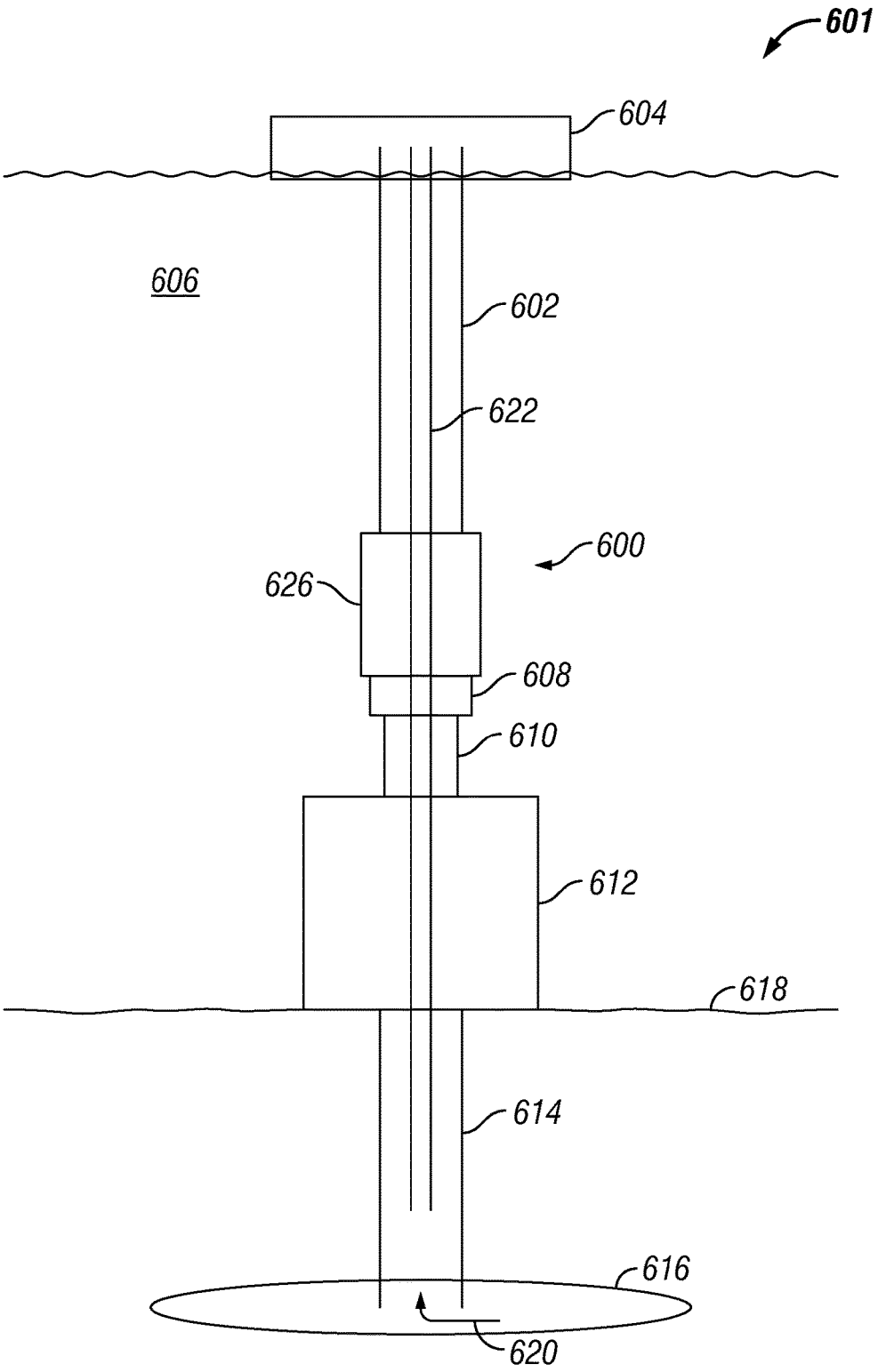
FIG. 8 is a schematic diagram of one embodiment of the well emergency separation tool positioned above a subsea reservoir.

FIG. 8:

FIG. 8 depicts another embodiment of the well emergency separation tool 600 positioned about wellsite 601. Riser 602 is fluidly connected to surface structure 604. Surface structure 604 floats on sea 606. Surface structure 604 may be, for example, a spar, a semisub, a TLP, an FPSO, a temporary or permanent storage system, a vessel, another containment apparatus, or a separator that separates components of fluid, such as gas and liquid, etc.

Opposite surface structure 604, riser 602 is fluidly connected to well emergency separation tool 600. Well emergency separation tool 600 comprises containment housing 626. Containment housing 626 is designed and constructed to be able to withstand the explosion of the explosive material in the well emergency separation tool. This maintains the integrity of the system and prevents flow from exiting the riser 602. Containment housing 626 contains a substantially vertical bore extending from riser 602 to flex joint 610. The outer surface of the containment housing 626 may be fluidly isolated from sea 606. Opposite riser 602, well emergency separation tool 600 is fluidly connected to flex joint 610 by connector element 608. Flex joint 610 extends from connector element 608 to blowout preventer (BOP) stack 612. Casing 614 is a tubular element fluidly connected to BOP stack 612. BOP stack 612 may be located at or above mudline 618. BOP stack 612 may be any BOP stack as are known in the art and commercially available, such as those provided by Cameron, Vetco-Gray, Patterson, Hydril, etc. and disclosed, for example, in U.S. Pat. No. 7,410,003, herein incorporated by reference in its entirety. Fluid may flow from reservoir 616 through casing 614 towards surface in the direction marked by arrow 620.

During drilling or workover operations, workstring 622 may extend from surface structure 604 to casing 614. Workstring 622 is contained within riser 2 and passes through well emergency separation tool 600, connector element 608, flex joint 610, or BOP stack 612.

It may be desired to have multiple well emergency separation tools 600 installed between riser 602 and BOP stack 612. A second well emergency separation tool 600 may be included for redundancy. Alternatively, additional well emergency separation tools 600 may be included if various sizes or types of workstring 622 will be utilized. It may be desirable to install several sets of well emergency separation tools 600 to increase flexibility of design. Well emergency separation tool 600 may be installed when drilling operations commence and left on the BOP stack until all completion and workover activities are finished. Alternatively, well emergency separation tool 600 may be left on the well indefinitely and may be removed only when the well is decommissioned or when certain portions of well emergency separation tool 600 need to be repaired or replaced. Well emergency separation tool 600 is independent of traditional BOP stacks 612.

Figure 9:
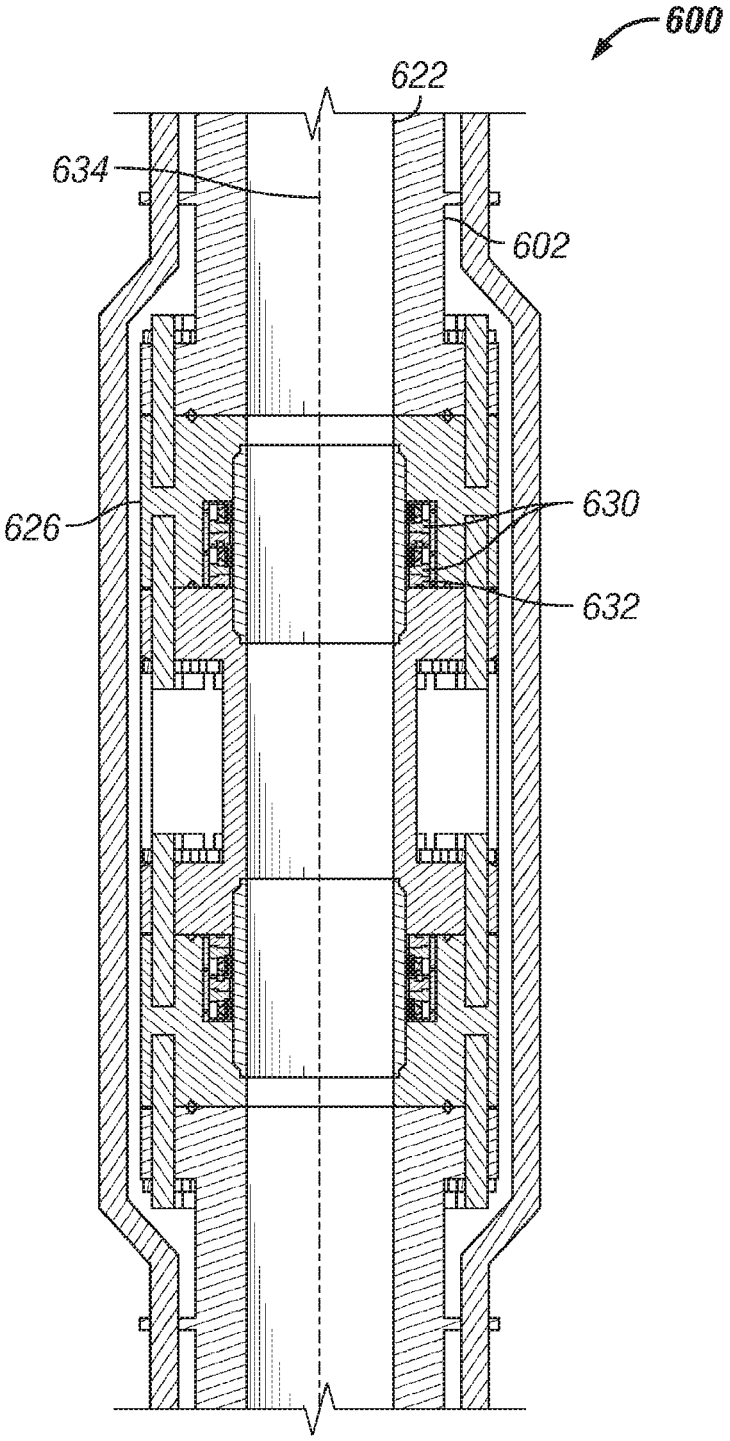
FIG. 9 is a schematic diagram of one embodiment of the internal structure of the well emergency separation tool.

FIG. 9 provides a schematic view of the internals of one embodiment of the well emergency separation tool 600. The containment housing has an outer surface 626, a charge carrier 632 that hold shaped charges 630 in a specific geometric configuration. The shaped charges 630 are positioned so that the plasma jet 636 generated by the explosives is directed towards the outer surface of the tubular element 622 in a manner that the tubular element will be separated. More particularly, the shaped charges are positioned at an angle that is not perpendicular to the longitudinal axis 634 of the tubular element.

Figure 10:
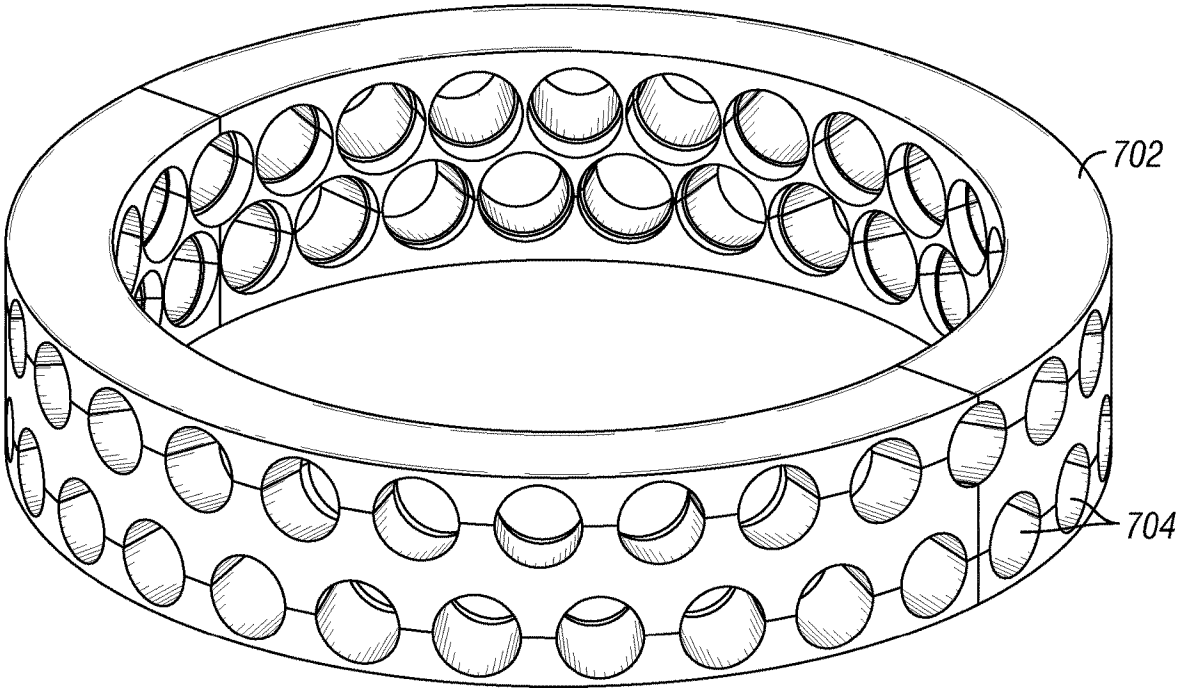
FIG. 10 is a schematic diagram of one embodiment of the charge carrier used in some embodiments of the well emergency separation tool.

FIG. 10 depicts one embodiment of a charge carrier 702. The charge carrier has a plurality of openings 704 for the placement of shaped charges. As can be seen from the drawing, the openings are angled so that the shaped charges will be positioned in the correct direction. This figure depicts a charge carrier with two rows of openings or openings in two geometric planes. The openings can be arranged in three or more rows of openings as necessary to provide a sufficient plasma jet to separate a tubular element.

Several different types of tubular elements may extend through the well emergency separation tool, and it is designed to separate different types and sizes of tubular elements. The different types of tubular elements are pipe, casing or drill string of varying diameters, drill collars of varying sizes, and any other equipment that is placed in a wellbore.

In one embodiment, there is disclosed a method of separating a tubular element, comprising providing a tubular element having an inner and an outer surface, a circumference of said outer surface, a longitudinal axis and a first end and a second end; radially surrounding said tubular element with an explosive material, wherein said explosive material is capable of generating a high-velocity plasma jet in response to an activation signal, and wherein said explosive material comprises an electrically conductive layer; transmitting said activation signal to said explosive material; generating said high-velocity plasma jet; and separating said tubular element into a first portion comprising said first end and a second portion comprising said second end when said high-velocity plasma jet penetrates said outer surface of said tubular element and exits said inner surface of said tubular element. In some embodiments, the method also includes securing said first end of said tubular element. In some embodiments, the method also includes completing an electrical circuit along said electrically conductive layer of said explosive material. In some embodiments, the method also includes providing a shock mitigator and activating said shock mitigator before said generating said high-velocity plasma jet step. In some embodiments, the shock mitigator is a bubble curtain formed by injecting an inert gas into a fluid. In some embodiments, the method also includes allowing said second portion of said tubular element to travel away from said first portion. In some embodiments, the tubular element is positioned above a wellsite, wherein said wellsite comprises a well flowing a produced fluid at a first rate and a flow control device connected to said well. In some embodiments, the method also includes closing said flow control device after said second portion of said tubular element has travelled away from said first portion. In some embodiments, the flow control device is a blowout preventer ram.

In some embodiments, the method also includes providing a ram body, wherein at least a portion of said explosive material is contained with said ram body, said ram body having an outer surface and an inner surface, said outer surface and said inner surface connected by a substantially flat face, said flat face having an arcuate recess designed to engage a portion of said circumference of said tubular element and a sealing element fixedly attached to said flat face. In some embodiments, the method also includes compressing said sealing element. In some embodiments, the method also includes providing a ram housing, wherein said ram housing comprises a first ram body and a second ram body. In some embodiments, the method also includes laterally translating said first ram body and said second ram body toward said tubular element, said first ram body radially encompassing a first portion of said circumference of said tubular element, and said second ram body radially encompassing a second portion of said circumference of said tubular element. In some embodiments, the method also includes laterally translating said first ram body and said second ram body away from said tubular element after said separating said tubular element into said first portion and said second portion step.

In some embodiments, the method includes providing a containment housing surrounding the explosive material wherein the containment housing can withstand the generating said high-velocity plasma jet step without being substantially damaged. In some embodiments, the method includes using explosive material in the form of a linear charge. In some embodiments, the method includes using explosive material in the form of shaped charges. The linear or shaped charges may be any type of charge known to one of ordinary skill in the art. In some embodiments, the method includes locating the explosive material in a self-contained charge carrier. The carrier may be made of any material, but it is preferably made of a composite material. In some embodiments, the shaped charges may be located in more than one geometric plane perpendicular to the longitudinal axis of the tubular element. In some embodiments, the shaped charges may be positioned at an angle such that the high-velocity plasma jet contacts the outer surface of the tubular element at an angle that is not perpendicular to the longitudinal axis of the tubular element. In some embodiments, the shaped charges may be positioned at an angle such that the high-velocity plasma jet contacts the outer surface of the tubular element at an angle to the longitudinal axis of the tubular element of from 45 to 89 degrees.

In one embodiment, there is disclosed a well emergency separation tool for separating a tubular element, comprising a tubular element having an inner and an outer surface, a circumference of said outer surface, and a first end and a second end; an explosive material, said explosive material radially surrounding said tubular element; a ram body, said ram body comprising an outer surface and an inner surface, said outer surface and said inner surface connected by a substantially flat face, wherein said flat face comprises an arcuate recess designed to engage a portion of said circumference of said tubular element, wherein at least a portion of said explosive material is contained with said ram body; and a trigger adapted to send an activation signal to said explosive material. In some embodiments, the tool further comprises a sealing element fixedly attached to said flat face. In some embodiments, the tool further comprises a first ram body and a second ram body. In some embodiments, the tool further comprises a ram housing, said ram housing having a thru-bore and an outer surface fluidly isolated from an external environment, wherein said first ram body and said second ram body are contained with said ram housing. In some embodiments, the tool further comprises a shock mitigator, wherein said shock mitigator is located external to said ram housing. In some embodiments, the tool further comprises a wellsite, wherein said wellsite comprises a subsea well flowing a produced fluid, a flow control device fluidly connected to said well, and a riser, wherein said well emergency separation tool is fluidly connected between said flow control device and said riser. In some embodiments, the flow control device is a blowout preventer. In some embodiments, the tool further comprises a plurality of well emergency separation tools fluidly connected between said flow control device and said riser.

In another embodiment, there is disclosed a well emergency separation tool for separating a tubular element, including: a tubular element having an inner and an outer surface, a circumference of said outer surface, a longitudinal axis, and a first end and a second end; an explosive material, said explosive material radially surrounding said tubular element; a self-contained charge carrier, wherein at least a portion of said explosive material is contained within said charge carrier; and a trigger adapted to send an activation signal to said explosive material. In some embodiments, the explosive material is in the form of shaped charges. In some embodiments, the tool includes a containment housing surrounding the explosive material that is sufficient to withstand a high velocity plasma jet generated by the explosive material and the vibrations, and shocks caused by the explosion. In some embodiments, the charge carrier is made of a composite material. In some embodiments, the shaped charges in the tool are located in more than one geometric plane perpendicular to the longitudinal axis of the tubular element. The shaped charges may be located in more than two geometric planes. In some embodiments, the shaped charges are positioned at an angle such that a high-velocity plasma jet generated by the shaped charges will be directed towards the outer surface of the tubular element at an angle that is not perpendicular to the longitudinal axis of the tubular element. In some embodiments, the shaped charges are positioned at an angle such that a high-velocity plasma jet generated by the shaped charges will be directed towards the outer surface of the tubular element at an angle to the longitudinal axis of the tubular element of from 45 to 89 degrees. In some embodiments, the trigger uses direct hydraulic means to send the activation signal. In some embodiments, the trigger uses wireless transmission means selected from the group consisting of acoustic, direct sight sonar and electromagnetic transmission to send the activation signal.

It will be understood from the foregoing description that various modifications and changes may be made in the preferred and alternative embodiments of the present invention without departing from its true spirit.

This description is intended for purposes of illustration only and should not be construed in a limiting sense. The scope of this invention should be determined only by the language of the claims that follow. The term "comprising" within the claims is intended to mean "including at least" such that the recited listing of elements in a claim are an open group. "A," "an" and other singular terms are intended to include the plural forms thereof unless specifically excluded.

The invention claimed is:

1. A method of separating a tubular element, comprising:

providing a tubular element having an inner and an outer surface, a circumference of said outer surface, a longitudinal axis and a first end and a second end;

radially surrounding said tubular element with an explosive shaped charge material, wherein said explosive shaped charge material is capable of generating a high-velocity plasma jet in response to an activation signal, wherein said explosive shaped charged material comprises an electrically conductive layer, and wherein said explosive shaped charge material is located in a self-contained charge carrier made of composite material, wherein the charge carrier comprises two rows of openings for placement of the explosive shaped charge material, wherein the explosive shaped charge material and self-contained charge carrier are carried by a ram body;

providing a containment housing surrounding said explosive shaped charge material;

transmitting said activation signal to said explosive material;

generating said high-velocity plasma jet; and separating said tubular element into a first portion comprising said first end and a second portion comprising said second end when said high-velocity plasma jet penetrates said outer surface of said tubular element and exits said inner surface of said tubular element.

2. The method of claim 1, further comprising securing said first end of said tubular element.

3. The method of claim 1, further comprising completing an electrical circuit along said electrically conductive layer of said explosive material.

4. The method of claim 1, further comprising providing a shock mitigator and activating said shock mitigator before said generating said high-velocity plasma jet step.

5. The method of claim 4, wherein said shock mitigator is a bubble curtain formed by injecting an inert gas into a fluid.

6. The method of claim 1, further comprising allowing said second portion of said tubular element to travel away from said first portion.

7. The method of claim 1, wherein said tubular element is positioned above a wellsite, wherein said wellsite comprises a well flowing a produced fluid at a first rate and a flow control device connected to said well.

8. The method of claim 7, further comprising closing said flow control device after said second portion of said tubular element has travelled away from said first portion.

9. The method of claim 8, wherein said flow control device is a blowout preventer ram.

10. The method of claim 1, further comprising: said ram body having an outer surface and an inner surface, said outer surface and said inner surface connected by a substantially flat face, said flat face having an arcuate recess designed to engage a portion of said circumference of said tubular element and a sealing element fixedly attached to said flat face.

11. The method of claim 10, further comprising compressing said sealing element.

12. The method of claim 10, further comprising providing a ram housing, wherein said ram housing comprises a first ram body and a second ram body.

13. The method of claim 12, further comprising laterally translating said first ram body and said second ram body toward said tubular element, said first ram body radially encompassing a first portion of said circumference of said tubular element, and said second ram body radially encompassing a second portion of said circumference of said tubular element.

14. The method of claim 13, further comprising laterally translating said first ram body and said second ram body away from said tubular element after said separating said tubular element into said first portion and said second portion step.

15. The method of claim 1, wherein the explosive shaped charge material is located in more than one geometric plane perpendicular to the longitudinal axis of the tubular element.

16. The method of claim 1, wherein the explosive shaped charge material is positioned at an angle such that the high-velocity plasma jet contacts the outer surface of the tubular element at an angle that is not perpendicular to the longitudinal axis of the tubular element.

17. The method of claim 1, wherein the explosive shaped charge material is positioned at an angle such that the high-velocity plasma jet contacts the outer surface of the tubular element at an angle to the longitudinal axis of the tubular element of from 45 to 89 degrees.

18. The method of claim 1, wherein the explosive shaped charge material is sufficient to separate a tubular element having an outer diameter of at least 16 inches.

19. The method of claim 1, wherein the explosive shaped charge material is sufficient to separate a drill collar.

20. A well emergency separation tool for separating a tubular element, comprising:

a tubular element having an inner and an outer surface, a circumference of said outer surface, and a first end and a second end;

an explosive material, said explosive material radially surrounding said tubular element and wherein the explosive material is located in a self-contained charge carrier made of composite material, wherein the charge carrier comprises two rows of openings for placement of the explosive shaped charge material;

a containment housing surrounding the explosive material, wherein the containment housing can withstand the generating said high-velocity plasma jet step without being substantially damaged;

a ram body, said ram body comprising an outer surface and an inner surface, said outer surface and said inner surface connected by a substantially flat face, wherein said flat face comprises an arcuate recess designed to engage a portion of said circumference of said tubular element, wherein at least a portion of said explosive material is carried by said ram body; and a trigger adapted to send an activation signal to said explosive material.

21. The well emergency separation tool of claim 20, further comprising a sealing element fixedly attached to said flat face.

22. The well emergency separation tool of claim 20, further comprising a first ram body and a second ram body.

23. The well emergency separation tool of claim 22, further comprising a ram housing, said ram housing having a thru-bore and an outer surface fluidly isolated from an external environment, wherein said first ram body and said second ram body are contained with said ram housing.

24. The well emergency separation tool of claim 23, further comprising a shock mitigator, wherein said shock mitigator is located external to said ram housing.

25. The well emergency separation tool of claim 20, further comprising a wellsite, wherein said wellsite comprises a subsea well flowing a produced fluid, a flow control device fluidly connected to said well, and a riser, wherein said well emergency separation tool is fluidly connected between said flow control device and said riser.

26. The well emergency separation tool of claim 25, wherein said flow control device is a blowout preventer.

27. The well emergency separation tool of claim 25, further comprising a plurality of well emergency separation tools fluidly connected between said flow control device and said riser.

28. A well emergency separation tool for separating a tubular element, comprising:

a tubular element having an inner and an outer surface, a circumference of said outer surface, a longitudinal axis, and a first end and a second end;

an explosive material, said explosive material radially surrounding said tubular element;

a containment housing surrounding the explosive material;

a self-contained charge carrier, wherein at least a portion of said explosive material is contained within said charge carrier and wherein the charge carrier comprises two rows of openings for placement of the explosive shaped charge material;

a ram body, wherein the at least a portion of said explosive material is carried by said ram body; and a trigger adapted to send an activation signal to said explosive material.

29. The well emergency separation tool of claim 28, wherein the explosive material is in the form of shaped charges.

30. The well emergency separation tool of claim 28, wherein the self-contained charge carrier is made of composite material.

31. The well emergency separation tool of claim 28, wherein the explosive material is located in more than one geometric plane perpendicular to the longitudinal axis of the tubular element.

32. The well emergency separation tool of claim 28, wherein the explosive material is positioned at an angle such that a high-velocity plasma jet generated by the shaped charges will be directed towards the outer surface of the tubular element at an angle that is not perpendicular to the longitudinal axis of the tubular element.

33. The well emergency separation tool of claim 28, wherein the explosive material is positioned at an angle such that a high-velocity plasma jet generated by the explosive material will be directed towards the outer surface of the tubular element at an angle to the longitudinal axis of the tubular element of from 45 to 89 degrees.

34. The well emergency separation tool of claim 28, wherein the trigger uses direct hydraulic means to send the activation signal.

35. The well emergency separation tool of claim 28, wherein the trigger uses wireless transmission means selected from the group consisting of acoustic, direct sight sonar and electromagnetic transmission to send the activation signal.

36. The well emergency separation tool of claim 28, further comprising a wellsite, wherein said wellsite comprises a subsea well flowing a produced fluid, a flow control device fluidly connected to said well, and a riser, wherein said well emergency separation tool is fluidly connected between said flow control device and said riser.

37. The well emergency separation tool of claim 36, wherein said flow control device is a blowout preventer.

38. The well emergency separation tool of claim 36, further comprising a plurality of well emergency separation tools fluidly connected between said flow control device and said riser.

* * * * *